US009644849B2

(12) United States Patent
Lee

(10) Patent No.: US 9,644,849 B2
(45) Date of Patent: May 9, 2017

(54) OVEN HAVING PYROLYSIS FUNCTION

(71) Applicant: Younghee Lee, Jeollabuk-do (KR)

(72) Inventor: Younghee Lee, Jeollabuk-do (KR)

( * ) Notice: Subject to any disclaimer, the term of this patent is extended or adjusted under 35 U.S.C. 154(b) by 263 days.

(21) Appl. No.: 14/348,613

(22) PCT Filed: Nov. 15, 2012

(86) PCT No.: PCT/KR2012/009625
§ 371 (c)(1),
(2) Date: Mar. 31, 2014

(87) PCT Pub. No.: WO2013/187561
PCT Pub. Date: Dec. 19, 2013

(65) Prior Publication Data

US 2014/0238381 A1 Aug. 28, 2014

(30) Foreign Application Priority Data

Jun. 12, 2012 (KR) ..... 10-2012-0062433

(51) Int. Cl.
*F24C 15/20* (2006.01)
*F24C 15/32* (2006.01)
*F24C 14/02* (2006.01)

(52) U.S. Cl.
CPC ..... *F24C 15/327* (2013.01); *F24C 14/02* (2013.01); *F24C 15/2014* (2013.01)

(58) Field of Classification Search
CPC ..... F24C 14/02
USPC ..... 126/21 A, 19 R, 273 A; 219/400
See application file for complete search history.

(56) References Cited

U.S. PATENT DOCUMENTS 3,364,912 A * 1/1968 Dills ..... F24C 14/025 126/21 A
4,287,870 A * 9/1981 Johnson ..... F24B 1/182 126/163 R
2005/0109760 A1* 5/2005 Tatsumu ..... F24C 15/325 219/399

* cited by examiner

*Primary Examiner* — Avinash Savani

(57) ABSTRACT

The oven having combustion function includes a cooking cavity; a heating means for emitting heat; a combustion tube for surrounding the heating means, and the combustion tube also being in fluid communication with the cooking cavity and a flow supply unit; a combustion space wherein odor-producing materials are removed by the heat from the heating means, the combustion space formed between the heating means and the combustion tube; a flow supply unit connected to the combustion tube for developing a flow of air through the combustion space; and a connection tube for connecting the flow supply unit to the combustion tube. The odor-producing materials are pyrolyzed by staying at least 0.5 seconds in the combustion space heated over 700° C. The oven has high energy efficiency since the heating means carries out thermal decomposition of the odor-producing materials and heats food by supplying radiant heat to the cooking cavity.

14 Claims, 3 Drawing Sheets

OVEN HAVING PYROLYSIS FUNCTION

FIELD OF THE INVENTION

The present invention provides a combustion device and method for effectively removing odor-producing materials, more specifically, an oven containing a device for thermal decomposition of odor-producing materials that occur when foods are heated in cooking cavity.

DESCRIPTION OF RELATED ARTS

Conventional cooking utensils have no function to remove volatile compounds and smells generated during cooking. The present invention relates to a device and method for effectively removing odor-producing materials in an oven cavity. Smoke or fumes generated during cooking make people feel unpleasant and may contain various harmful materials that cause damage to human health. In order to solve the above problems, a range hood for discharging fumes outside is installed in the kitchen. However, because the range hood is located relatively far from the place where cooking is carried out, the cooking, fumes are diffused to the kitchen and other rooms while the user prepares foods on the range.

The oven is a cooking utensil that heats food in a cooking cavity in which heating elements are installed. The oven simultaneously heats the surface and the inside of food so as to effectively cook bulky food, and hence, the use of the oven is on the rise. However, the conventional ovens have no functions to purify contaminants such as smoke or fumes generated during cooking. Some of the ovens have self-cleaning functions to cause pyrolysis at temperatures of about 400-500° C. in order to remove food contaminants stained and accumulated on the walls of the cooking cavity. However, the above case adopts a method of re-heating the cooking cavity after taking out the food and cannot solve the problem of diffusing fumes during cooking. Therefore, a device for effectively removing fumes generated during cooking is desired.

The following patents are known in the art and are incorporated by reference herein: Korean Pat. Nos. 10-0518444; 10-0555420; and U.S. Pat. Nos. 6,316,749; 6,318,245; 7,878,185; 8,101,894.

SUMMARY OF THE INVENTION

The present invention relates to a combustion device and method for effectively removing odor-producing materials in an oven cavity. An object of the present invention is to provide a multi-purpose combustion device that includes a heating means adapted to heat up food in the cooking cavity, and also to provide a cleaning effect. In detail, another object of the present invention is to solve problems of inconvenience due to contamination of cooking fumes by providing an oven having pyrolysis function.

Conventional ovens comprise a cooking cavity, heaters for heating the cooking cavity, a temperature sensor for sensing the operating temperature of the cooking cavity, a convection chamber for circulating air, a control panel for controlling the heaters and the convection chamber, and an oven body.

According to an aspect of the present invention, the oven further comprises a heating means, a combustion tube, a combustion space, a connection tube, and a flow supply unit, as well as the components of a conventional oven as described above.

The cooking cavity adapted to receive food is surrounded by cavity walls and an oven door. The heating means is located within the cooking cavity, and is enclosed by a combustion tube. A combustion space is formed between the heating means and the combustion tube. The flow supply unit connects to the combustion tube via a connection tube, moves air in the cooking cavity to the combustion space, and expels the cleaned air outside. The flow supply unit includes a fan that can generate a stream of air. The connection tube is configured to transfer an air pressure differential to the combustion tube to maintain the pressure within the cooking cavity lower than the atmospheric pressure.

The fan is adapted to introduce the steam inclusive of the odor-producing materials in the cooking cavity into the combustion space. The connection tube is configured to transfer an air pressure differential to the combustion tube and to move the air in the cooking cavity.

The odor-producing materials are prevented from spreading out of the cooking cavity and are pyrolyzed by passing through the combustion space heated to over 700° C., over a period of at least 0.5 seconds.

It is preferable that a venturi tube is connected between the fan and the connection tube. The venturi tube is connected between the outlet of the fan and the connection tube in such a way as to communicate air. The venturi tube includes a nozzle which has a narrow air path and is connected to the outlet of a fan. The flow of air from the fan becomes faster at the nozzle, which creates low pressure at the side of the nozzle where an inlet hole is thrilled. Because the connection tube is connected between the inlet hole and the combustion tube, the pressure differential created by the fan causes air in the cooking cavity to enter into the combustion space and move toward the inlet hole.

The oven of the present invention further includes a convection chamber located on the rear side cavity walls that forcibly circulates air in the cooking cavity.

The combustion process for removing contaminants in the oven according to the present invention includes the steps of: 1) supplying electric power to the heating means to increase temperature of the combustion space to 700° C. or to the preset temperature; 2) operating the flow supply unit to start thermal decomposition of the contaminants when the temperature of the combustion space reaches 700° C. or the preset temperature; 3) operating the heating means and the flow supply unit during the preset cooking time to decompose contaminants generated during cooking; and 4) terminating the power supply to the heating means and the flow supply unit.

A control panel is installed on the oven body to control the combustion process. The control panel includes at least one controlling means for setting the timer and operating modes which control the heating means and the fan.

The oven has high energy efficiency since the heating means both carries out thermal decomposition of the odor-producing materials and heats food by supplying radiant heat to the cooking cavity

DETAILED DESCRIPTION OF THE INVENTION

The objects and features of the present invention will be now made in detail to the preferred embodiments of the present invention with reference to the attached drawings.

First Embodiment

Figure 1:
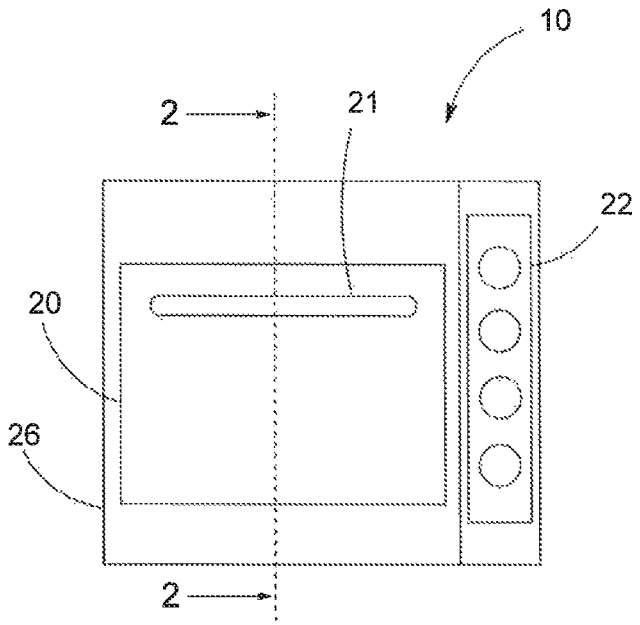
FIG. 1 is a front view showing an oven 10 having combustion function according to a first preferred embodiment of the present invention.

FIG. 1 is a front view showing an oven 10 having a combustion device according to a first preferred embodiment of the present invention. An oven door 20 having a door knob 21 is rotatably attached to an oven body 26 forming the outward appearance of the oven 10. The oven door 20 seals the front side of a cooking cavity 29 to prevent volatile compounds or fumes from escaping from the cooking cavity, to make racks easily go in and out of the cooking cavity, and to allow a user to check the level of cooked foods in the cooking cavity. A control panel 22 is disposed at one side of the front face of the oven body 26. The control panel 22 includes at least one controlling means for setting temperature and time so that the inside of the cooking cavity 29 can keep a preset temperature for an appropriate period of time.

Figure 2:
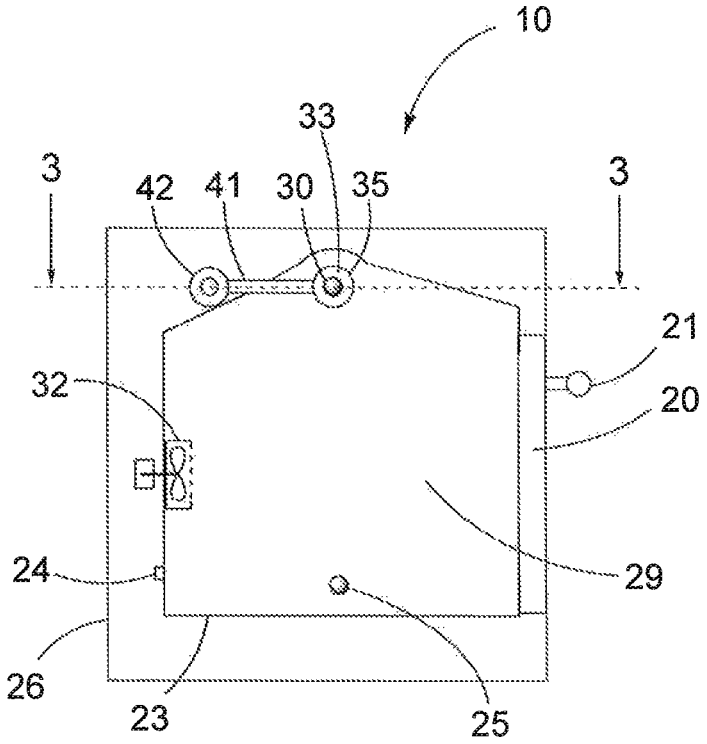
FIG. 2 is a side sectional view taken along the line 2-2 of FIG. 1.
Figure 3:
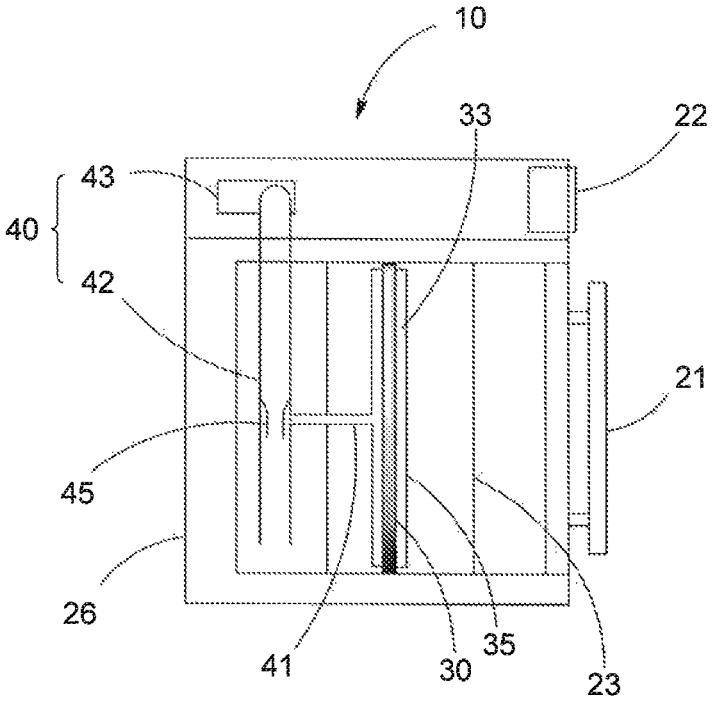
FIG. 3 is a sectional view taken along the line 3-3 of FIG. 2.

FIG. 2 is a side sectional view taken along the line 2-2 of FIG. 1 showing the inside configuration of the cooking cavity 29 and the oven body 26, and FIG. 3 is a sectional view taken along the line 3-3 of FIG. 2. Referring to the drawings, the present invention will be described in detail as follows. The cooking cavity 29 is surrounded by a cavity wall 23, has an open front face, and has a space for cooking foods inside. The cooking cavity 29 has a heater 25 mounted inside the cavity for heating foods at the proper temperature. Moreover, the cooking cavity 29 further includes a heating means 30 mounted at the upper part of the cavity and a combustion tube 35 having a hollow portion formed to enclose the heating means 30. A combustion space 33 is formed between the heating means 30 and the combustion tube 35.

The heating means 30 can generate heat and raise the temperature of the combustion space 33 at least 700° C. or preset temperature. It is preferable that the heating means 30 is selected from a group consisting of a sheath heater, a cartridge heater, or a heat wire wound in a coil form connected to a power supply.

The combustion tube 35 is selected from a group consisting of ceramics, a quartz tube, or heat-resisting metals and is formed in a hollow tube shape with both ends open. It is preferable that the combustion tube is enclosed by a heat resisting metallic cover (not shown) in order to protect it from external impacts.

The cooking cavity 29 further includes a convection chamber 32 for forcibly circulating the air within the cooking cavity 29. The convection chamber 32 is located at the rear side of the cooking cavity 29 and receives power generated from a motor, such that a fan inside the chamber works to inhale the air of the cooking cavity and to discharge air back to the cooking cavity 29. Because there is a temperature difference over 600° C. between the center of the cooking cavity and the top portion near the combustion tube 35, the air is forcibly convected by the convection chamber 32 and it rapidly increases the temperature of the cooking cavity 29.

The cooking cavity 29 includes a temperature sensor 24 for sensing temperature of the cooking cavity 29. The temperature sensor 24 mounted on the cavity wall 23 detects the inside temperature of the cooking cavity 29 and interrupts or connects electricity to the heater 25 and the convection chamber 32.

A flow supply unit 40, connected to the combustion tube 35, maintains the pressure within the cooking cavity 29 lower-than-the-atmospheric pressure and expels the steam inclusive of odor-producing materials in the cooking cavity 29 outside. The flow supply unit 40 includes a venturi tube 42 and a fan 43. The fan 43 is a centrifugal fan that has an inlet and an outlet and serves to create a flow of air. Namely, the fan 43 forms a vacuum state at the inlet (not shown) of the fan 43 and generates an air flow at the outlet (not shown) of the fan 43 by forming a pressure differential when its blades rotate. Therefore, an air pressure lower-than-the-atmospheric pressure can be generated in the combustion space 33 by the flow supply unit 40, which causes smoke and odor-producing materials in the cavity to get sucked into the combustion space 33 to be thermally decomposed. Additionally, the flow supply unit 40 prevents contaminants generated during cooking from spreading out, inhales air from the combustion tube 35, and discharges air out of the oven 10. The connection tube 41 is connected to the middle section of the combustion tube 35 and transfers the steam and air including carbon dioxide from the combustion tube 35 to the venturi tube 42.

The venturi tube 42 is connected between the outlet (not shown) of the fan 43 and the connection tube 41 to communicate air. The venturi tube 42 includes a nozzle 45 disposed at the middle portion thereof which makes a narrower air path, and hence, the venturi tube 42 has a structure that its air path becomes narrowed near the nozzle 45 and becomes widened again. An inlet hole 46 is formed on the side of the nozzle in the venturi tube 42. The inlet of the venturi tube 42 is connected to the outlet of fan 43, and hence, the flow of air from the fan 43 becomes faster at the nozzle 45, which creates a low pressure (vacuum state) at the inlet hole 46. Because one side of the connection tube 41 is connected to the inlet hole 46, and the opposite side of the connection tube 41 is connected to the middle section of the combustion tube 35, a pressure difference (vacuum) is generated in the venturi tube 42 that causes the air of the cooking cavity 29 to get sucked into the combustion space 33 and to move towards the inlet hole 46. Furthermore, as described above, because the venturi tube 42 is connected to the outlet of the fan 43, vapor and air of high temperature from the combustion space 33 are eventually discharged out of the venturi tube 42 without being in direct contact with the fan 43.

Figure 4:
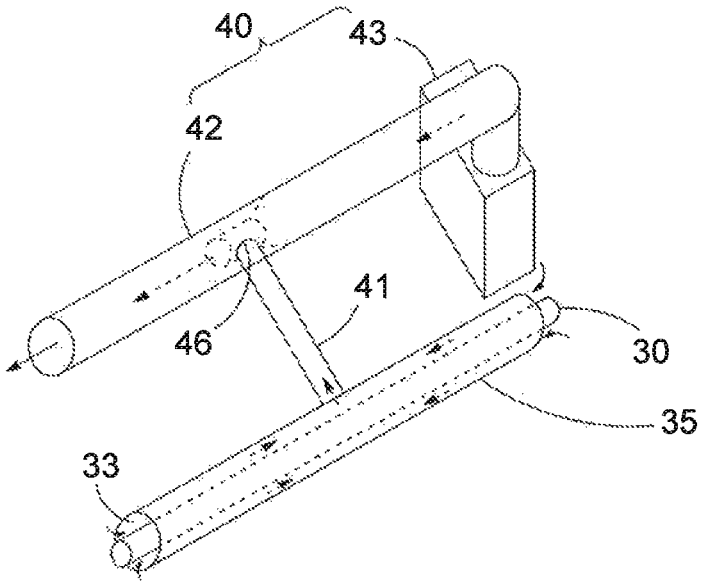
FIG. 4 is a configurative view of some components showing a flow of air in the oven 10.

FIG. 4 is a configurative view of some main parts showing a flow of air in the oven 10. Referring to the drawing, the combustion process of contaminants in the cooking cavity 29 will be described in detail. First, when electric power to the oven 10 is supplied, the heating means 30 is heated so that temperature of the combustion space 33 increases. When the combustion space 33 reaches a temperature over 700° C. or a preset temperature, the fan 43 starts to operate. The air current by the fan 43 forms pressure difference (vacuum) in the connection tube 41 through the inlet hole 46 of the venturi tube 42. The vacuum is transferred to the combustion space 33 inside the combustion tube 35 and inhales the contaminants from the cooking cavity 29 through both open ends of the combustion tube 35. During the preset cooking time, the heating means 30 and the fan 43 are turned on so as to thermally decompose the contaminants generated during cooking. The combustion cycle comes to an end when the supply of electricity to the heating means 30 and the fan 43 is terminated.

Second Embodiment

Figure 5:
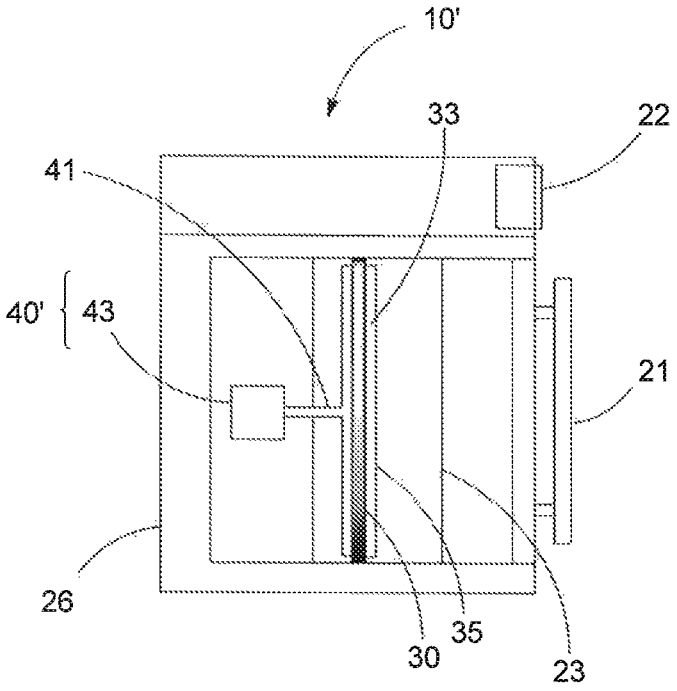
FIG. 5 is a sectional view showing an oven 10' having combustion function according to a second preferred embodiment of the present invention.

FIG. 5 is a sectional view showing an oven 10' having combustion function according to a second preferred embodiment of the present invention. The oven 10' according to the second preferred embodiment has the same components as the oven 10 according to the first preferred embodiment except for the flow supply unit 40. As illustrated in the drawing, the inlet (not shown) of the fan 43 is connected with the connection tube 41, and vacuum generated by the fan 43 is transferred to the combustion tube 35 through the connection tube 41, so that the air of high temperature inside the combustion space 33 enters into the fan 43 and is discharged through the outlet (not shown) of the fan 43. Accordingly, it is preferable that the flow supply unit 40' uses the fan 43 being made of a heat-resistant material, which can be operated at high temperature enough to endure hot air from the combustion space 33, or lower the temperature of hot air from the combustion space 33 before it is inhaled into the fan 43.

Figure 6:
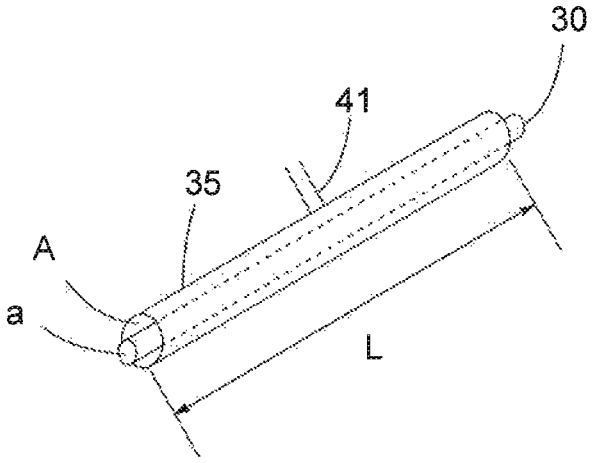
FIG. 6 is a perspective view of a heating means 30 and a combustion tube 35.

As described above through the embodiments, in order to completely decompose contaminants generated during cooking, it is preferable that the combustion space 33 maintains its temperature over 700° C. and the contaminants pass through the combustion space 33 over a period at least 0.5 seconds. The time (t) that the contaminants pass through the combustion space 33 can be controlled, and it is indicated by the Mathematical Formula 1 and a drawing illustrated in FIG. 6.

$$t = \frac{L}{V} = \frac{(A-a)\cdot L}{Q} \geq 0.5(\text{second}) \qquad \text{[Mathematical Formula 1]}$$

wherein t is the period of time that air containing contaminants passes through the combustion space, L is the length (m) of the combustion tube. A is a cross-sectional area of the combustion tube ($m^2$), a is a cross-sectional area of the heating means ($m^2$), (A−a) is a cross-sectional area of the combustion space ($m^2$), Q is a flow rate ($m^3$/second), and V is a speed (m/second) of the air flowing through the combustion space.

The time that the air containing contaminants passes through the combustion space 33 may be kept over 0.5 seconds by controlling the length of the combustion tube 35, the cross-sectional area of the combustion space 33, the flow rate of the air inhaled into the combustion space 33, and the speed of the air flowing through the combustion space 33. Particularly, it is natural that the flow rate and speed of the air flowing through the combustion space 33 can be sufficiently controlled through control of the operation conditions of the fan 43.

The combustion process for removing contaminants according to the present invention includes the steps of: 1) supplying electric power to the heating means 30 to increase temperature of the combustion space 33 to 700° C. or to the preset temperature; 2) operating the fan 43 to start thermal decomposition of the contaminants when the temperature of the combustion space 33 reaches 700° C. or the preset temperature; 3) operating the heating means 30 and the fan 43 during the preset cooking time to decompose contaminants generated during cooking; and 4) terminating the power supply to the heating means 30 and the fan 43.

A control panel 22 is disposed at one side of the front face of the oven body 26. The control panel 22 includes at least one controlling means for setting the timer (not shown) and operating modes which control the heating means 30 and the fan 43.

While the present invention has been particularly shown and described with reference to exemplary embodiments thereof, it will be understood by those of ordinary skill in the art that various changes in form and details may be made therein without departing from the spirit and scope of the present invention as defined by the following claims.

| LIST OF NUMERALS | |
|---|---|
| 10, 10': oven | 20: oven door |
| 21: door knob | 22: control panel |
| 23: cavity wall | 24: temperature sensor |
| 25: heater | 26: oven body |
| 29: cooking cavity | 30: heating means |
| 32: convection chamber | 33: combustion space |
| 35: combustion tube | 40, 40': flow supply unit |
| 41: connection tube | 42: venturi tube |
| 43: fan | 45: nozzle |
| 46: inlet hole | |

What is claimed is:

1. An oven comprising:

a cooking cavity surrounded by cavity walls and an oven door;

a heater mounted inside the cooking cavity and adapted to heat food inside the cooking cavity;

a heating means located within the cooking cavity for pyrolysis;

a combustion tube enclosing the heating means, the combustion tube being in fluid communication with the cooking cavity and a flow supply unit, a combustion space formed between the heating means and the combustion tube in which odor-producing materials from cooking are decomposed by the heat from the heating means;

a connection tube for connecting fluid communication between the flow supply unit and the combustion tube;

wherein the flow supply unit includes a fan that develops flow of air through the combustion space.

2. The oven of claim 1, wherein the heating means carries out thermal decomposition of the odor-producing materials and heats the combustion tube through which radiant heat is transferred to the cooking cavity.

3. The oven of claim 1, wherein the odor-producing materials are pyrolyzed by staying at least 0.5 seconds in the combustion space heated over 700° C.

4. The oven of claim 1, further comprising a convection chamber adapted to circulate the air in the cooking cavity.

5. The oven of claim 1, wherein the heating means is selected from a group consisting of a sheath heater, a cartridge heater, or a heat wire wound in a coil form.

6. The oven of claim 1, wherein the combustion tube is selected from a group consisting of ceramics, heat-resisting metals, or a quartz tube.

7. The oven of claim 1, wherein the combustion tube has a hollow tube-type shape with both ends open.

8. The oven of claim 1, wherein the flow supply unit includes a fan that can generate a stream of air, and have an inlet and an outlet.

9. The oven of claim 1, wherein the connection tube is connected to the middle section of the combustion tube.

10. The oven of claim 1, wherein the flow supply unit further comprising a venturi tube which is connected between the connection tube and the outlet of the fan.

11. The oven of claim 1, wherein the flow supply unit inhales air from the combustion tube and discharges air out of the oven.

12. The oven of claim 1, wherein the fan is a centrifugal fan.

13. The oven of claim 1, further comprising a temperature sensor for sensing the temperature of cooking cavity.

14. The oven of claim 6, wherein the combustion tube is enclosed by a heat resisting metallic cover for protecting it from external impacts.

* * * * *